United States Patent [19]

Mailund

[11] 4,294,784

[45] Oct. 13, 1981

[54] METHOD OF HAULING GRANULATES AND SIMILAR MATERIAL

[76] Inventor: Steinar J. Mailund, Kamomillegatan 9, 653 45 Karlstad, Sweden

[21] Appl. No.: 24,688

[22] Filed: Mar. 28, 1979

[30] Foreign Application Priority Data

May 3, 1978 [SE] Sweden ..... 7805088

[51] Int. Cl.[3] ..... B01J 2/06

[52] U.S. Cl. ..... 264/14

[58] Field of Search ..... 264/13, 14, 5

[56] References Cited

U.S. PATENT DOCUMENTS

| | | | |
|---|---|---|---|
| 3,334,159 | 8/1967 | Campbell | 264/13 |
| 3,888,956 | 6/1975 | Klint | 264/5 |
| 4,081,500 | 3/1978 | Malcolm | 264/14 |

*Primary Examiner*—James R. Hall

*Attorney, Agent, or Firm*—Murray and Whisenhunt

[57] ABSTRACT

A method of granulating metals is disclosed, wherein molten drops of metal are quenched in a treatment vessel. An inclined riser is connected to the lower portion of the treatment vessel by way of a bended transition section, and the particles of metal which have solidified during passage through the vessel pass through the bend and up the inclined riser. Compressed air is introduced into the lower part of the inclined riser to transport the metallic particles and associated water up the riser, with the particles being withdrawn from the vessel at such a rate that after discharge from the inclined riser, and removal of at least part of the water associated therewith, the metallic particles have a temperature which is above the temperature of the water in the vessel. The water level in the vessel is controlled by way of an overflow weir or other arrangement.

6 Claims, 4 Drawing Figures

METHOD OF HAULING GRANULATES AND SIMILAR MATERIAL

The present invention relates to a method for the treatment of metal granulates or other comparatively heavy piece-shaped products with water in a process vessel for hauling the granulates up from the vessel.

The invention is especially useful in the production of metallic granulates from a cast which is melted and formed into individual molten drops which are quenched and allowed to solidify in a bath. The granulates are then hauled up from the bath. The invention can be applied in e.g. the production of metallic granulates according to any one of the processes described in Swedish Pat. No. 312 642, U.S. Pat. No. 2,488,353, British Pat. No. 785,290 and German Pat. No. 947 663 and No. 1 024 315. In the haulage of granulates produced by e.g. one of these previously known methods, primarily baskets or buckets have been used to carry the granulates out of the coolant basin after introduction of a molten charge has finished. This among other things means results in the granulates remaining in the basin for a longer time than is really required for the solidification of the granulates. Therefore they are excessively cooled which has the decisive disadvantage that the heat content of the granulates is not enough for drying the granulates after they have been hauled up from the water. So in the case of earlier methods extensive drying of the granulates was required after they had been hauled up from the water. Another method used to a certain extent is to haul up the granulates by means of endless conveyor belts or paternoster bailing works. But even these devices are slow, so that the granulates are cooled to an extent requiring extensive subsequent drying. In addition, such equipment is relatively complicated, and, by having movable parts immersed in the coolant basin, the equipment is exposed not only to the influence of the water but also to rather extreme physical and chemical conditions present in the coolant basin in the course of the granulation process.

An object of the present invention is therefore to provide a method for hauling granulates up from the coolant vessel as they have been cooled so far as to solidify and not sinter into larger aggregates.

Another object of the invention is to bring about the haulage without using movable means of haulage immersed in the water.

One aspect of the invention is to use as a haulage means the cooling water already used for cooling the droplets to setting temperature. An object of the invention therefore is to render the total process economics cheaper by using as a means of haulage the aforesaid cooling water.

Another object is to utilize in the haulage the static pressure of the coolant in the vessel.

An object is also to add to the speed of the hauling-water by means of the use of compressed air, partly utilizing the known technique used in e.g. so-called air lifts.

A further object is to make the haulage easier—and possible—by using a riser, partly by arranging the riser inclined and, partly by agitating the water contained in the riser to bring it into vigorous turbulence, thus preventing air-bubbles from gathering along the "ceiling" of the inclined riser. Another object is to reduce wear of the riser walls caused by the granulates tumbling around in consequence of the turbulence.

Further objects with characteristics and advantages of the invention will appear from the following description of best modes of carrying out the invention. Reference will be made to the enclosed drawings which FIG. 1 shows a vertical section through an apparatus for carrying out the method according to a first arrangement of the invention.

Figure 1:
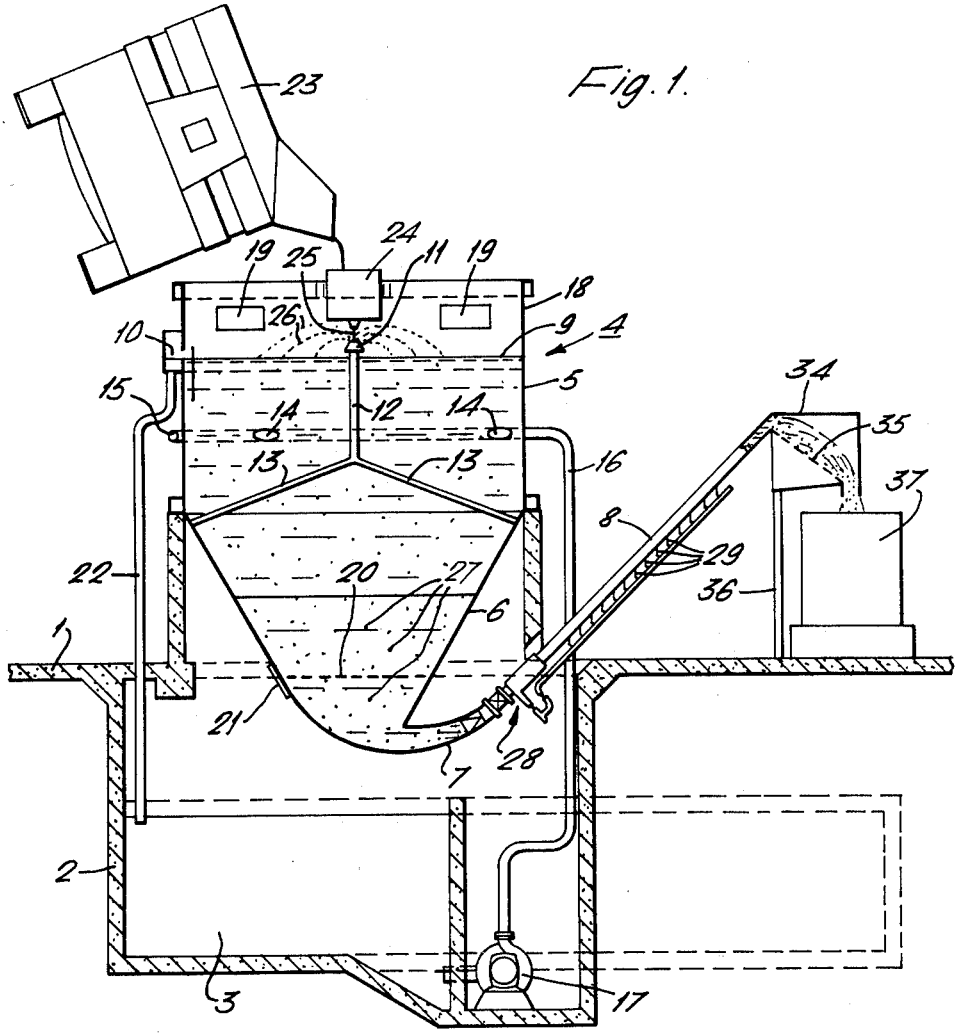
Figure 2:
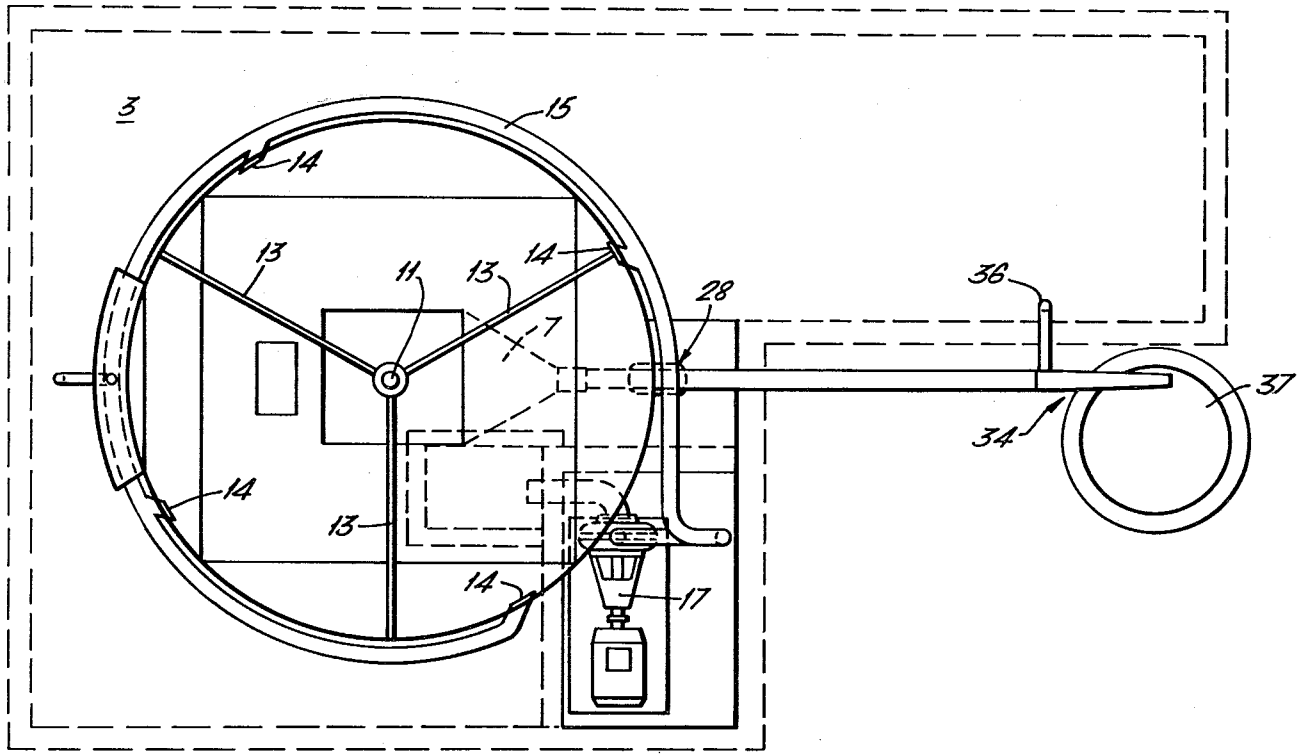
FIG. 2 shows the same apparatus of FIG. 1 as seen from above.
Figure 3:
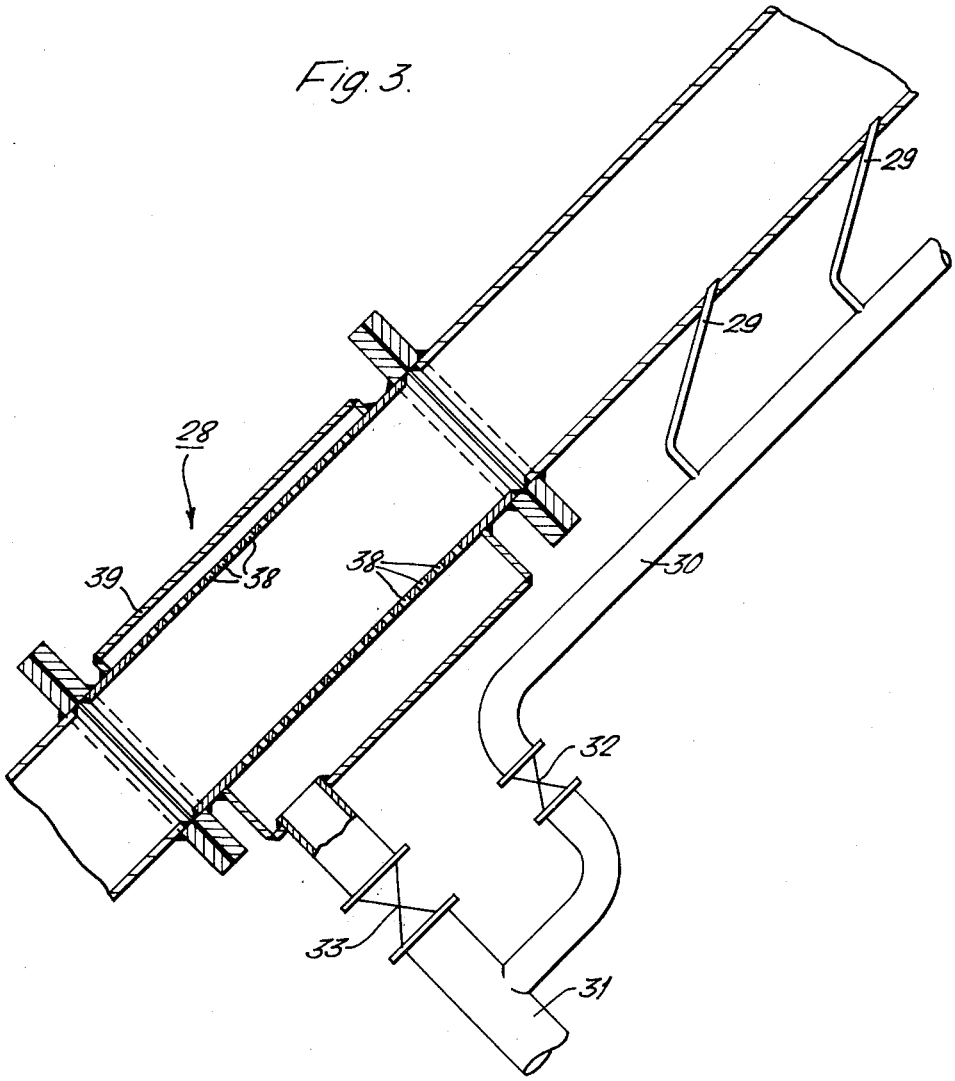
FIG. 3 shows in more detail part of a device for haulage of granulates.

The apparatus illustrated in FIGS. 1–3 is intended for producing metallic granulates from a cast, e.g., pig iron granulates. Generally, the apparatus is placed in connection with a smelter. To reduce height it is often suitable to partly lower the apparatus below floor level. The arrangement chosen here illustrates such a case, where bed 2 is provided below the level of floor 1. In the lower part of bed 2 is a cooling water container in the form of a water basin 3. A granulating vessel 4 is arranged above the basin 3. Vessel 4 has an upper part consisting of a vertical cylinder 5 having a circular section, and a lower part having the shape of a conical funnel 6 with a downward taper. The "spout" of the funnel is, however, bent obliquely upwardly and thus constitutes an inclined riser 8 at an angle of about 45°. The transition piece between funnel 6 and riser 8 has the shape of a softly rounded bend 7.

During granulation the vessel 4 is filled with cooling water to a level 9 determined by a spillway 10. Just above the water level 9 is arranged a plate 11 of ceramic or stone material mounted on a rod 12 extending down into the vessel 4 and being supported by stays 13. Cooling water enters the cylindrical part 5 of the vessel 4 by a number of inlet nozzles 14 distributed along the periphery of the vessel. The nozzles 14 are turned obliquely inwardly, over a distribution line 15 going all around the cylinder 5 and are fed by cooling water from the basin 3 through a riser 16. A pump 17 is arranged for conveying the cooling water from the basin 3 to the distribution line 15. The cylinder 5 extends above water level 9 where it constitutes a splashboard 18. The splashboard 18 is provided with inspection openings 19. The lower part of the funnel-shaped part 6 of the vessel 4—slightly above the bend 7—is provided with a grate 20 for catching possibly formed major aggregates of granulates or metal clumps, and an access manhole cover 21 is situated in the area of the grate 20. A pipe 22 returns used cooling water which has entered the spillway 10 back to the cooling-water basin 3.

FIG. 1 shows how a metal cast is teemed in molten form from a ladle 23 into a casting mold 24. On the bottom of the mold there is arranged a nozzle vertically above the plate 11 at a suitable height, and as a stream 25 of molten metal exits the nozzle, the stream hits plate 11 and is disintegrated into sprays of droplets 26 which fall into the water of the vessel 4. The drops solidify into granulates 27 as they sink through the cooling water and are guided by the funnel 6 downwardly towards the bend 7 after having passed through the grate 20. The granulates are then forced up via the bend through the riser 8 by means of an air-water mixture.

To ensure that the granulates are hauled at the required rate and that the apparatus has the required capacity, it is crucial that both water flow rate and water turbulence be properly adjusted. According to the invention quite a number of parameters discussed below are adjusted to attain an optimal combination effect. One such parameter is the static pressure in the bend 7 and the riser 8, which pressure is obtained by introducing cooling water into the vessel 4 at a flow rate greater than the maximum flow through the riser 8, with the superfluous amount being drained via the spillway 10. The water level 9 of the vessel 4 can thereby be kept constant as can also the difference between the water depth of the vessel 4 and the haulage height; this latter consideration constitutes a second parameter. A third parameter is the diameter of the riser 8. A fourth parameter is the extra impulse and thereby extra hauling effect—pumping effect—created by the introduction of compressed air into the riser 8. Fifth and sixth parameters are the pressure of the air introduced and the air flow. A seventh parameter is the method of introducing the air into the riser 8, and an eighth parameter is the angle of inclination of the riser. To sum up, therefore, according to the invention, it is the combination of the static pressure and the pumping effect obtained by the air addition that, at the selected hauling height and riser diameter, brings about the desired hauling effect. In addition, the method of introducing the air is of essential importance to the desired result, as well as the inclination of the riser 8.

FIG. 3 shows in enlargement part of the air injection apparatus used for introducing air into the riser 8. This apparatus comprises a known emitter 28 and a series of nozzles 29 arranged in the lower riser face extending along the whole length of the riser 8 above the emitter 28. An air inlet pipe 30 is connected to the nozzles 29, and this pipe is fed from a feeder 31 being common to the emitter 28. The air supply to the nozzles 29 can be shut off by valve 32 and the air supply to the emitter 28 can be controlled by valve 33.

The riser 8 is connected to a separator 34 in which the granulates are separated from the water. The granulates are recovered on a grate 35, through which water flows and is led off through a pipe 36 back to the basin 3. The granulates are collected in a container 37 having a wire mesh bottom. Hot air can possibly be admitted into the container through the wire mesh bottom for a certain subsequent drying of the granulates, especially if these are fine-grained. The main part of the moisture not removed in the separator is, however, evaporated in the container 37 owing to the fact that the granulates still have a very high temperature after their rapid haulage from the cooling water.

The function of the hauling apparatus will now be further explained. As mentioned above there are two hauling mechanisms in operation, viz. the static pressure created by the water column of the vessel 4, and the air fed into the riser 8. The air injection apparatus consists of the emitter 28 and the nozzles 29. The compressed air is injected into the emitter 28 from a compressor (not shown) via the pipe 31, the valve 33 and a great number of openings 38 in the wall of the riser 8, these openings being surrounded by a sleeve 39. The compressed air injected through the openings 38 mixes with the water in the riser 8 and creates bubbles which expand while rising, adding to the speed at which the water moves through the riser 8. However, these bubbles tend to adhere to the upper wall of the riser 8 where they can form a more or less continuous channel. This tendency becomes more and more accentuated as the angle of inclination of the riser is reduced. Normally this problem is overcome by arranging air lifts in vertical position, thus eliminating this tendency entirely. The possibility of hauling up material as heavy as granulates of iron or even heavier metals is, however, severly limited by such an arrangment. By inclining the riser, according to the invention, and at the same time providing for a sufficiently high speed of the water through the riser 8, it is possible to rapidly haul up even the above-mentioned heavy products. As indicated above the necessary speed is obtained by the static pressure and by the injection of compressed air. To prevent the air from gathering along the "ceiling" of the riser, air is also injected at the "bottom" of the riser through nozzles 29, extending between the emitter 28 and the vent of the riser 8. By means of the air injected through the nozzles 29 the water-air mixture is vigorously agitated and this loosens the bubbles from the "ceiling" of the riser. The driving effect of the separate bubbles on the water of the riser is essentially increased through this, partly by the bubbles adopting a spherical shape after having left contact with the "ceiling" of the riser and, partly by the bubbles being spread out over the whole section of the riser 8. Also the air bubbles created by the injection through the nozzles 29 contribute themselves—i.e. not only indirectly by affecting the turbulence inside the tube—to bubbles being spread out over the whole cross section of the riser. At the same time the injection of compressed air through the nozzles 29 yields the effect that the heavy granulates are largely prevented from gathering at the "bottom" of the riser but are rather in the same way as the bubbles dispersed over the entire cross section of the riser. Water speeds, air quantities, air pressure, riser diameter, hauling height, angle of inclination and other parameters are adjusted one to another with regard to the circumstances present in each individual case. Characteristic of the invention is then the possibilities provided by its principle when it comes to carrying this optimization through.

Figure 4:
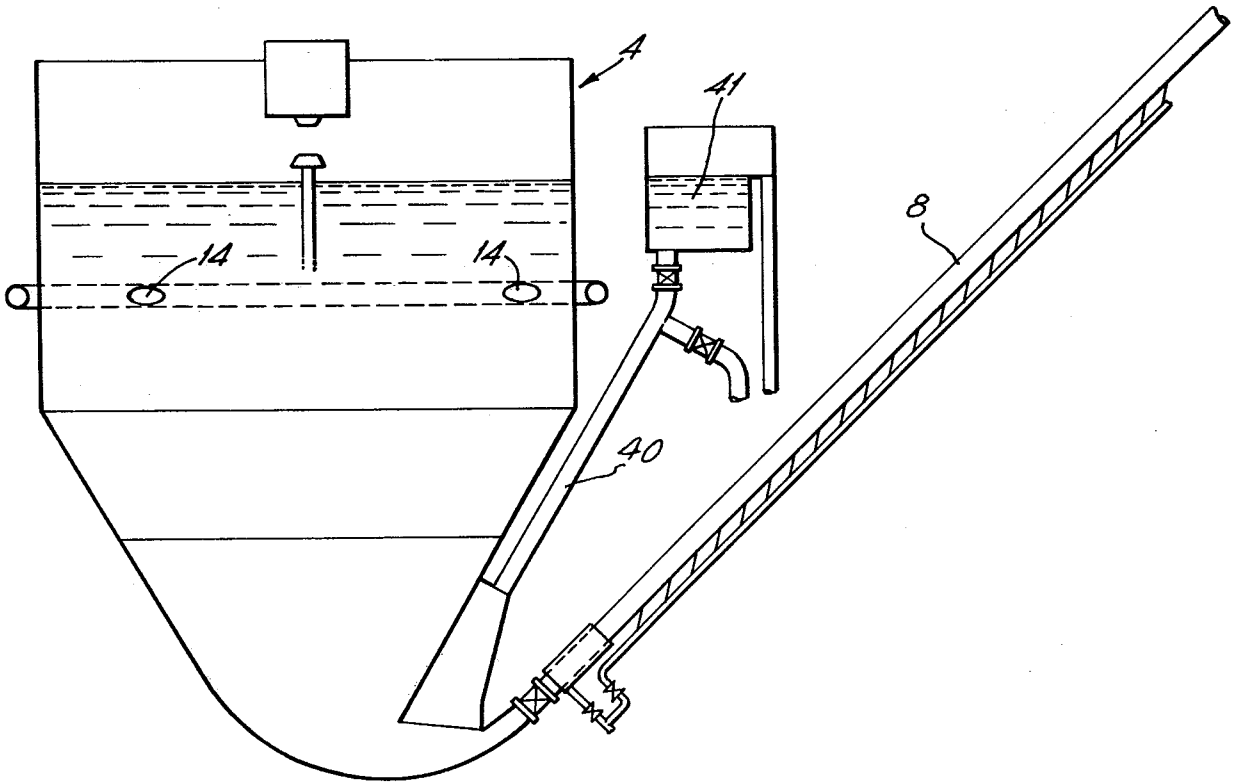
FIG. 4 shows an alternative arrangement of the apparatus for carrying out the method, with only those parts important for understanding of the arrangement being shown for clarity.

FIG. 4 shows an alternative form of carrying the method out according to the invention and the apparatus to be used therefor. A difference in relation to the preceding design is that the spillway 10 and the pipe 22 from the spillway have been replaced by a riser 40 from the bottom part of the vessel 4. The riser 40 leads to a water tank 41 from which water can be forced into the vessel 4 through the nozzles 14. Just as in the previously shown case the tank 41 can receive water from the separator 34. In this design the riser 8 has been shown to have a considerably longer relative length, thus ending at a higher level than the water level 9 of the vessel 4. This illustrates the case that the principles of the invention can also be utilized for hauling up materials to a level being higher than the water level of the process vessel 4.

I claim:

1. A method of producing metallic particles having improved drying efficiency, said method comprising:

(a) providing a treatment vessel having a main portion and an inclined riser having a lower part, said treatment vessel including a curved transition section leading from said main portion to said inclined riser, said treatment vessel having a predetermined level of water therein;

(b) introducing individual molten droplets of a metal into said water in said main portion of said treatment vessel to quench said droplets and solidify same to form metallic particles;

(c) passing said metallic particles from said main portion through said curved transition section to said inclined riser;

(d) introducing compressed air into said lower part of said inclined riser to rapidly transport said metallic particles and a first portion of said water through said curved transition section and up said inclined riser, said metallic particles being formed so that upon solidification, they have an elevated temperature above the temperature of said water in said treatment vessel, at least a portion of said elevated temperature being retained by said metallic particles during passage through said treatment vessel and up said inclined riser;

(e) adjusting the level of said water in said treatment vessel by means other than said inclined riser, to thereby maintain said predetermined level of water in said treatment vessel; and (f) removing at least a part of said first portion of water from said metallic particles after rapid passage through said inclined riser, to recover metallic particles having improved drying efficiency, wherein after removal of part of said first portion of water said metallic particles still have an elevated temperature above the temperature of the water in said treatment vessel, thereby causing evaporation of residual water associated with said metallic particles.

2. Method of claim 1, wherein said metal is pig iron.

3. Method of claim 1, wherein said compressed air is injected into said inclined riser through an emitter arranged in said lower part of said riser.

4. Method of claim 3, wherein additional compressed air is injected into said riser above said emitter.

5. Method of claim 4, wherein said additional compressed air is injected into said riser above said emitter through a series of nozzles located in a lower face of the riser along the length thereof.

6. A method of producing metallic particles having improved drying efficiency, said method comprising:

(a) providing a treatment vessel having a generally conically shaped main portion, an inclined riser extending away from said treatment vessel and having a lower part, and a curved transition section located at the bottom of said treatment vessel and leading from said generally conically shaped main portion towards said inclined riser, said treatment vessel having a predetermined level of water therein;

(b) introducing individual molten droplets of a metal into said water in said main portion of said treatment vessel, said molten droplets solidifying during passage through said water to form metallic particles;

(c) passing said metallic particles from said main portion of said treatment vessel through said curved transition section to said inclined riser, said metallic particles being guided towards said curved transition section by said generally conically shaped main portion;

(d) introducing compressed air through an emitter located in said lower part of said inclined riser to rapidly transport said metallic particles and a first portion of said water through said curved transition section and up said inclined riser, said metallic particles being formed so that upon solidification they have an elevated temperature above the temperature of said water in said treatment vessel, at least a portion of said elevated temperature being retained by said metallic particles during passage through said treatment vessel and up said inclined riser;

(e) adjusting the level of said water in said treatment vessel by means other than said inclined riser, to thereby maintain said predetermined level of water in treatment vessel; and (f) removing at least a part of said first portion of water from said metallic particles after rapid passage through said inclined riser to recover metallic particles having improved drying efficiency, wherein after removal of said part of said first portion of water said metallic particles still have an elevated temperature above the temperature of said water in said treatment vessel, thereby causing evaporation of residual water associated with said metallic particles.

* * * * *